US006084580A

United States Patent [19]

Takahashi et al.

[11] Patent Number: 6,084,580

[45] Date of Patent: Jul. 4, 2000

[54] VOLTAGE GENERATING CIRCUIT AND LIQUID CRYSTAL DISPLAY DEVICE INCORPORATING THE VOLTAGE GENERATING CIRCUIT

[75] Inventors: Masahiro Takahashi, Tenri; Yoshiyuki Kokuhata, Nara, both of Japan

[73] Assignee: Sharp Kabushiki Kaisha, Osaka, Japan

[21] Appl. No.: 09/093,411

[22] Filed: Jun. 9, 1998

[30] Foreign Application Priority Data

Jun. 19, 1997 [JP] Japan ..... 9-163055

[51] Int. Cl.[7] ..... G09G 3/36

[52] U.S. Cl. ..... 345/211; 345/95

[58] Field of Search ..... 345/211, 212, 345/213, 208, 209, 210, 94, 95, 96

[56] References Cited

U.S. PATENT DOCUMENTS 5,510,814 4/1996 Ise .
5,729,246 3/1998 Masuko ..... 345/211
5,818,406 10/1998 Tsuchi et al. ..... 345/211
5,912,655 6/1999 Hoshino et al. ..... 345/211
5,929,847 7/1999 Yanagi et al. ..... 345/211
5,945,970 8/1999 Moon et al. ..... 345/211

FOREIGN PATENT DOCUMENTS 8262406 10/1996 Japan .

*Primary Examiner*—Xiao Wu

[57] ABSTRACT

A voltage generating circuit for driving a display device having a capacitive element, such as a liquid crystal display device, switches a switch between two terminals so as to output an input voltage $V_1$ from one of the input terminals as it is in a period in which the switch is connected one of the terminals. In this period, a capacitor is charged. On the other hand, in a period in which the switch is connected to the other of the terminals, the voltage generating circuit outputs from the output terminal a voltage $V_2$ as the sum voltage of the charged voltage ($V_1$) on the capacitor and an input voltage $V_2-V_1$ from the other of the input terminals. A reverse current flowing from the capacitive element of the display device through the output terminal is stored on the capacitor, and then used.

17 Claims, 12 Drawing Sheets

VOLTAGE GENERATING CIRCUIT AND LIQUID CRYSTAL DISPLAY DEVICE INCORPORATING THE VOLTAGE GENERATING CIRCUIT

FIELD OF THE INVENTION

The present invention relates to a voltage generating circuit for driving a display device using a capacitive display element, such as a liquid crystal display device, and to a liquid crystal display device incorporating the voltage generating circuit.

BACKGROUND OF THE INVENTION

In a resent information-oriented society, movable digital assistants, particularly, personal digital assistants (PDA) have been the center of public attention. One of the objectives to be achieved by the personal digital assistants is a lowering of power consumption. As the display device for use in the personal digital assistants, a liquid crystal display device has been most commonly used. There is also great demand for a lowering of power consumption in respect of the liquid crystal display device.

The liquid crystal display devices are roughly classified into two types, namely, passive matrix type and active matrix type. The active matrix type liquid crystal display devices are superior to the passive matrix type liquid crystal display devices in terms of the display quality. One type of the active matrix display device uses a three-terminal non-linear element, such as a TFT (thin film transistor), as a switching element. Another type of the active matrix display device uses a two-terminal non-linear element, such as an MIM (metal insulator metal), as a switching element. The two-terminal type switching element has the following advantages over the three-terminal type element. Namely, the two-terminal type switching element can be obtained at low cost because it can be produced by a simple process. Moreover, since there are only two terminals, the electrode wiring is simpler, and therefore the two-terminal type switching element achieves a higher aperture ratio of the pixel.

The active matrix type liquid crystal display devices using the two-terminal non-linear element can achieve high-contrast and even displays by an amplitude selective addressing scheme, but suffers from a drawback that a residual image (seizure) is apt to occur. In order to reduce the residual image, for example, an addressing scheme disclosed in Japanese publication of unexamined patent application (Tokukaihei) No. 8-262406 employs a method of switching one selecting period of a scanning signal among three voltage levels (the driving method with the selection period being divided into the first through third periods).

Here, a conventional driving method of this type is explained. First, referring to FIG. 3, a typical structure of a liquid crystal display device is explained.

The liquid crystal display device includes a liquid crystal display panel 50. The liquid crystal display panel 50 is provided with data electrode lines X1 through Xn, and scanning electrode lines Y1 through Ym. Additionally, in order to drive the liquid crystal panel, the liquid crystal display device includes a control section 55 for generating control signals, voltage generating circuits 51, 53 for generating voltages according to the control signal, a scanning electrode driver 54 for generating a scanning signal based on the voltage generated by the voltage generating circuit 53 and applying the scanning signal to the scanning electrode lines Y1 through Ym, and a data electrode driver 52 for generating a data signal based on the voltage generated by the voltage generating circuit 51 and applying the data signal to the data electrode lines X1 through Xn.

Referring now to FIG. 16, the following description will explain various signals used in the driving method with the selection period being divided into the first through third periods. In FIG. 16, $V_P$ represents a scanning signal applied to the scanning electrode lines Y1 through Ym. The scanning signal $V_P$ is generated as follows.

The voltage generating circuit 53 generates scanning electrode driver input signals $V_H$, $V_L$, $V_M$, and inputs these signals into the scanning electrode driver 54. Here, the scanning electrode driver input signal $V_H$ is a rectangular wave in which voltages $V_1$ and $V_2$ alternately appear, and the scanning electrode driver input signal $V_L$ is a rectangular wave in which voltages $V_4$ and $V_5$ alternately appear. The scanning electrode driver input signal $V_M$ is a constant voltage as a non-selected voltage.

In the scanning electrode driver 54, the scanning voltage $V_P$ is generated based on the scanning electrode driver input signals $V_H$, $V_L$, $V_M$ according to control signals such as a scanning clock signal LP, a scanning start signal S and an alternating inverted signal M. Specifically, the scanning electrode driver 54 generates the scanning voltage $V_P$ by selectively outputting the scanning electrode driver input signal $V_H$ or $V_L$ in a selecting period $T_S$, and by outputting the scanning electrode driver input signal $V_M$ as the non-selected voltage in a non-selecting period.

In order to generate a rectangular wave by outputting voltages of two different levels alternately like the scanning electrode driver input signal $V_H$ or $V_L$, the voltage generating circuit 53 includes a voltage switching circuit shown in, for example, FIG. 17. The voltage switching circuit shown in FIG. 17 has a p-channel MOS transistor 151 and an n-channel MOS transistor 152 so as to generate the scanning electrode driver input signal $V_H$. By controlling the p-channel MOS transistor 151 and n-channel MOS transistor 152 to be repeatedly turned into the ON state and OFF state alternately by control signals CS1, CS2, input voltages $V_1$, $V_2$ are alternately output as an output voltage $V_0$. As a result, the scanning electrode driver input signal $V_H$ is generated.

FIG. 18 is a waveform illustration showing the relationship between the output voltage $V_0$ of the voltage switching circuit of FIG. 15 and an output current $I_0$. When a voltage like the output voltage $V_0$ is applied to a capacitive element, such as a liquid crystal, a reverse current a is produced as shown by the waveform of the current $I_0$ in a switching timing from the high voltage $V_2$ to low voltage $V_1$. The reverse current a is a cause of a waste of power, and increases the power consumption. Furthermore, this voltage switching circuit requires an input voltage of the same level as an output voltage. Therefore, the peripheral members that perform voltage switching need to have a withstand voltage not lower than the output level, resulting in an increase in the production cost.

SUMMARY OF THE INVENTION

It is an object of the present invention to provide a low-power-consuming voltage generating circuit at low cost.

In order to achieve the above object, a voltage generating circuit of the present invention is a voltage generating circuit for supplying a voltage to a display device having a capacitive element, which includes:

an output terminal connected to the display device;

two input terminals to which voltages $V_a$ and $V_b$ are input, respectively;

a switch, provided between the output terminal and the input terminals, for switching a state between first and second states;

a capacitor provided between the switch and the output terminal; and a rectifying element connected to the capacitor in parallel, and is characterized by that when the switch is in the first state, the voltage $V_a$ is output from the output terminal, and the capacitor is charged, and when the switch is in the second state, a sum voltage $V_d$ of a voltage $V_c$ charged on the capacitor and one of the voltages $V_a$ and $V_b$ input from the input terminals is output from the output terminal, $V_a$ and $V_d$ have the same polarity with respect to a reference voltage, $|V_a|<|V_d|$, and $|V_b|<|V_d|$ With this structure, when the switch is in the first state, the voltage $V_a$ input from the input terminal is output as it is from the output terminal, and the capacitor is charged. When the switch is switched to the second state, the sum voltage $V_d$ of the voltage $V_c$ charged on the capacitor and one of the input voltages $V_a$ and $V_b$ is output from the output terminal. Namely, according to the switching operation of the switch, the voltages $V_a$ and $V_d$ are output alternately from the output terminal. The output voltages $V_a$ and $V_d$ have a positive polarity with respect to the reference voltage, and satisfy the relationship $|V_a|<|V_d|$. Therefore, when the output voltage is switched from $V_d$ to $V_a$, i.e., when immediately after the switch is switched to the first state from the second state, the charge stored in the capacitive element of the display device flows as a reverse current into the voltage generating circuit through the output terminal. The reverse current is guided to and stored on the capacitor by the rectifying effect of the rectifying element. Thereafter, when the switch is switched to the second state, the reverse current is effectively used, thereby achieving a lowering of power consumption.

Meanwhile, in a conventional structure, in order to output two levels of voltages $V_a$ and $V_d$, it is necessary to input the voltages $V_a$ and $V_d$ of the same level as the output voltage. Thus, the component parts of the voltage generating circuit are required to have a sufficient withstanding property against the voltage $V_d$ which has a greater absolute value of the electric potential difference with respect to the reference voltage than the electric potential difference between the reference voltage and the other output voltage. In order to meet such a requirement, the above-mentioned structure uses the voltage $V_c$ charged on the capacitor. Therefore, the voltages $V_a$ and $V_b$ having smaller absolute values of the electric potential differences with respect to the reference voltage compared to the voltage $V_d$ can be used as the input voltages. Accordingly, the required withstanding property for the component parts of the voltage generating circuit is lowered, thereby achieving reduction in cost.

The above-mentioned voltage generating circuit can be constructed so that $V_d=V_b+V_c$, and $V_c=V_a$.

With this structure, in a period in which the switch is in the first state, the voltage $V_a$ as one of the input voltages is output from the output terminal, and a voltage $V_c$ across the terminals of the capacitor becomes equal to the voltage $V_a$ due to the charge stored on the capacitor. A voltage $V_d$ to be output when the switch is switched to the second state becomes the sum of the voltage $V_b$ as the other of the input voltage and the voltage $V_c$ charged on the capacitor, i.e., $V_a$. Namely, it is possible to produce output voltages of two levels, $V_a$ and $V_a+V_b$, from the input voltages $V_a$ and $V_b$. In other words, for example, if the $V_a$ and $V_b$ are $V_1$ and $V_2-V_1$, respectively, it is possible to generate $V_1$ and $V_2$ as the output voltages.

Alternatively, the above-mentioned voltage generating circuit can be constructed so that $V_d=V_a+V_c$, and $V_c=V_a-V_b$.

With this structure, when the switch is in the first state, the voltage $V_a$ as one of the input voltages is output from the output terminal, and the voltage $V_c$ across the terminals of the capacitor becomes equal to the voltage $V_a-V_b$ due to the amount of charge stored on the capacitor. Moreover, the voltage $V_d$ to be output when the switch is switched to the second state becomes the sum of the voltage $V_a$ and the voltage $V_c$ charged on the capacitor, i.e., $V_a-V_b$. Namely, it is possible to produce output voltages of two levels, $V_a$ and $2V_a-V_b$, from the input voltages $V_a$ and $V_b$. In other words, for example, if the input voltages $V_a$ and $V_b$ are $V_1$ and $2V_1-V_2$, respectively, it is possible to generate $V_1$ and $V_2$ as the output voltages.

Besides, the above-mentioned voltage generating circuit can be constructed so that the capacity of the capacitor is smaller than the load capacity.

With this structure, by appropriately setting the capacity of the capacitor, it is possible to set the value of one of the two levels of the output voltages, which has a greater electrical potential difference with respect to the reference voltage than the other of the output voltages, to a desired value, without changing the values of the input voltages.

Furthermore, a liquid crystal display device according to the present invention includes the above-mentioned voltage generating circuit, and a liquid crystal panel as the display device.

In this liquid crystal display device, a non-linear element, for example, TFT and MIM, used as a switching element in the pixel of the liquid crystal panel functions as the capacitive element. With the use of the above-mentioned voltage generating circuit in this liquid crystal display device, even the liquid crystal display device can have the benefit of the use of the above-mentioned voltage generating circuit. It is thus possible to provide a low-power-consuming liquid crystal display device at low cost.

For a fuller understanding of the nature and advantages of the invention, reference should be made to the ensuing detailed description taken in conjunction with the accompanying drawings.

DESCRIPTION OF THE PREFERRED EMBODIMENTS

[Embodiment 1]

The following description will explain an embodiment of the present invention with reference to FIGS. 1 to 6.

Figure 3:
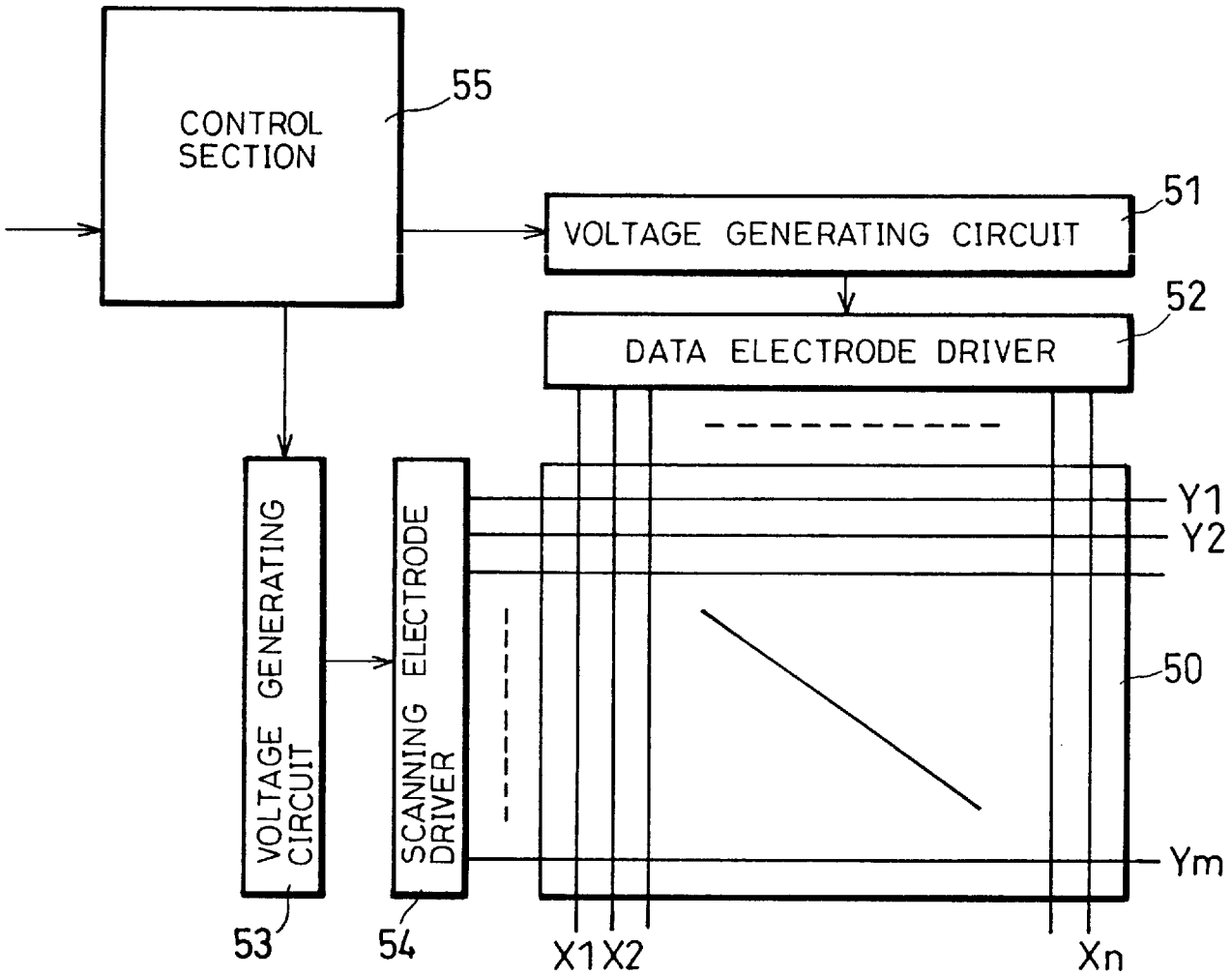
FIG. 3 is a block diagram illustrating a schematic structure of a liquid crystal display device as one embodiment of a display device of the present invention.

FIG. 3 is a block diagram showing a schematic structure of a liquid crystal display device (display device) according to one embodiment of the present invention. This liquid crystal display device includes a liquid crystal display panel 50. The liquid crystal display panel 50 has data electrode lines X1 through Xn and scanning electrode lines Y1 through Ym, arranged to cross each other at right angles. Besides, in order to drive the liquid crystal panel 50, the liquid crystal display device includes a control section 55 for generating a control signal, voltage generating circuits 51, 53 for generating voltages according to the control signals, a scanning electrode driver 54 for generating a scanning signal based on the voltage generated by the voltage generating circuit 53 and applying the scanning signal to the scanning electrode lines Y1 through Ym, and a data electrode driver 52 for generating a data signal based on the voltage generated by the voltage generating circuit 51 and applying the data signal to the data electrode lines X1 through Xn. The voltage generating circuit 53 is a voltage generating circuit according to the present invention, and the voltage generating circuit 51 may have a known structure.

Figure 4:
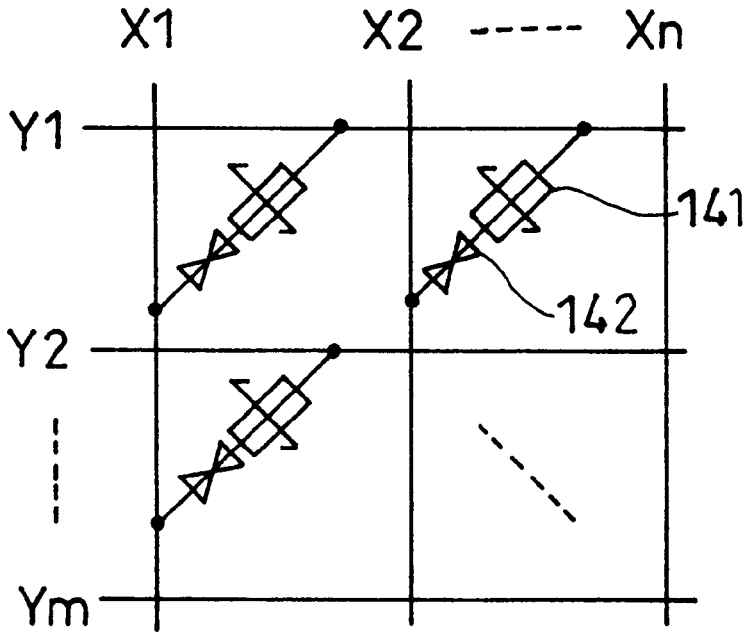
FIG. 4 is a circuit diagram illustrating an equivalent circuit of pixels of the liquid crystal display device shown in FIG. 3.

In the liquid crystal display 50, as illustrated in FIG. 4, each region separated by the data electrode lines X1 through Xn and scanning electrode lines Y1 through Ym corresponds to one pixel. Each region is provided with a liquid crystal element 141 and a two-terminal non-linear element 142. The liquid crystal element 141 and two-terminal non-linear element 142 are connected in series so that one of the electrodes of each liquid crystal element 141 is connected to any of the data electrode lines X1 through Xn, and one of each two-terminal non-linear element 142 is connected to any of the scanning electrode lines Y1 through Ym.

Figure 5:
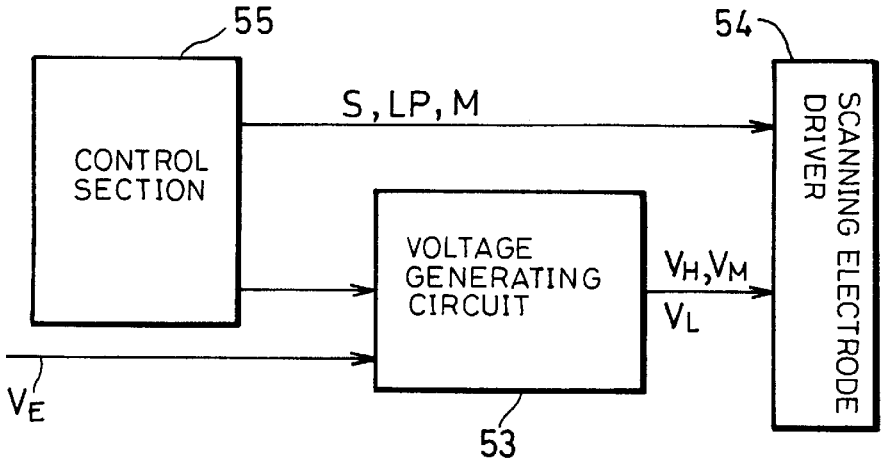
FIG. 5 is a block diagram illustrating the input paths of control signals and an input voltage to a scanning electrode driver of the liquid crystal display device shown in FIG. 3.

FIG. 5 is a block diagram showing the input path of the control signals from the control section 55 to the scanning electrode driver 54, and the input path of the input voltage.

The control section 55 generates a scanning clock signal LP, a scanning start signal S and an alternating inverted signal M as control signals, and outputs these control signals to the scanning electrode driver 54 and voltage generating circuit 53.

The voltage generating circuit 53 generates scanning electrode driver input signals $V_H$, $V_L$, $V_M$ based on an external input voltage $V_E$, according to the control signals from the control section 55, and outputs these signals into the scanning electrode driver 54.

Figure 6:
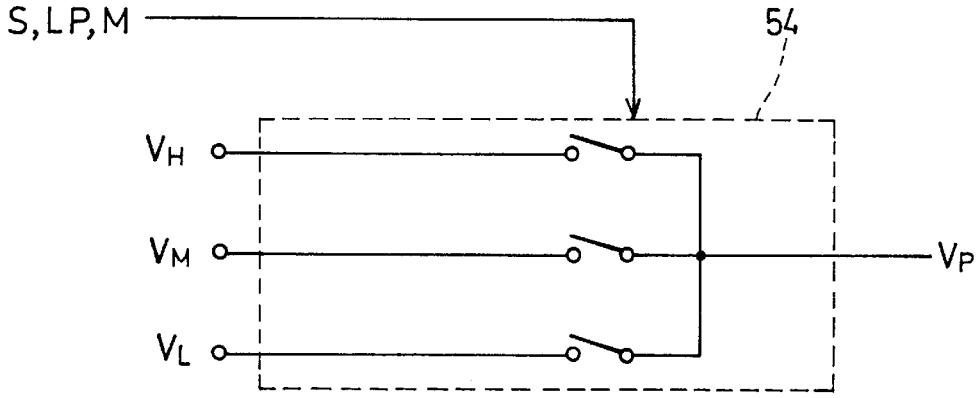
FIG. 6 is an equivalent circuit diagram illustrating the structure of the scanning electrode driver.

FIG. 6 is a circuit diagram showing the structure of the scanning electrode driver 54. A scanning signal $V_P$ is generated by selectively outputting one of the scanning electrode driver input signals $V_H$, $V_L$, $V_M$ generated by the voltage generating circuit 53, according to the scanning clock signal LP, scanning start signal S and alternating inverted signal M as the control signals. The scanning signal $V_P$ is applied to the scanning electrode lines Y1 through Ym.

Figure 1:
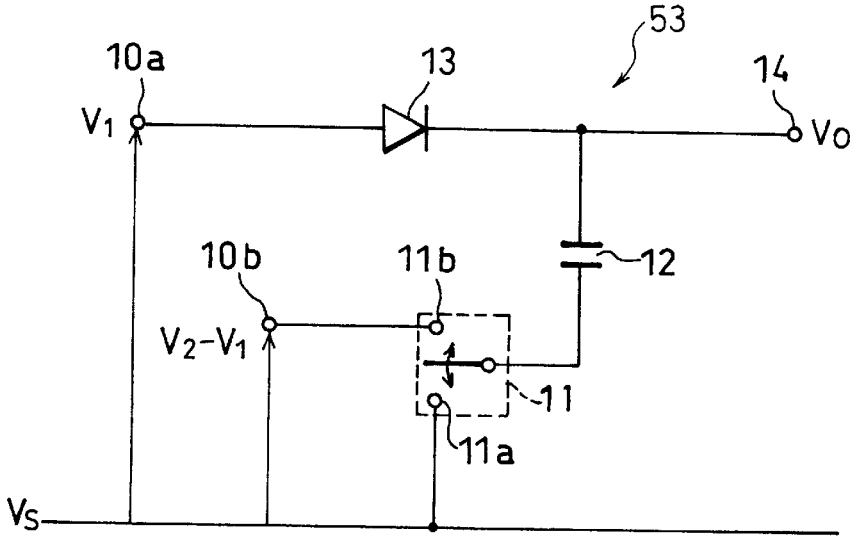
FIG. 1 is a circuit diagram illustrating a schematic structure of a voltage generating circuit according to one embodiment of the present invention.

FIG. 1 illustrates an example of the structure of the voltage generating circuit 53 of the liquid crystal display device of this embodiment. The voltage generating circuit 53 has input terminals 10*a*, 10*b*. The input voltages to the input terminals 10*a*, 10*b* are constant voltages of positive polarity with respect to a reference voltage $V_S$. Their electric potentials to the reference voltage $V_S$ are $V_1$, and $V_2-V_1$, respectively. Here, the voltages satisfy the relationship $V_S<V_1<V_2$.

A diode (rectifying element) 13 is disposed between the input terminal 10*a* and the output terminal 14. A switch 11 for switching the reference voltage $V_S$ and the input voltage $V_2-V_1$ from the input terminal 10*b* is provided. A terminal of the switch 11, connected to the reference voltage $V_S$ is represented by 11*a*, while a terminal connected to the input voltage $V_2-V_1$ is indicated by 11*b*. A capacitor 12 is positioned between the switch 11 and output terminal 14.

Figure 2:
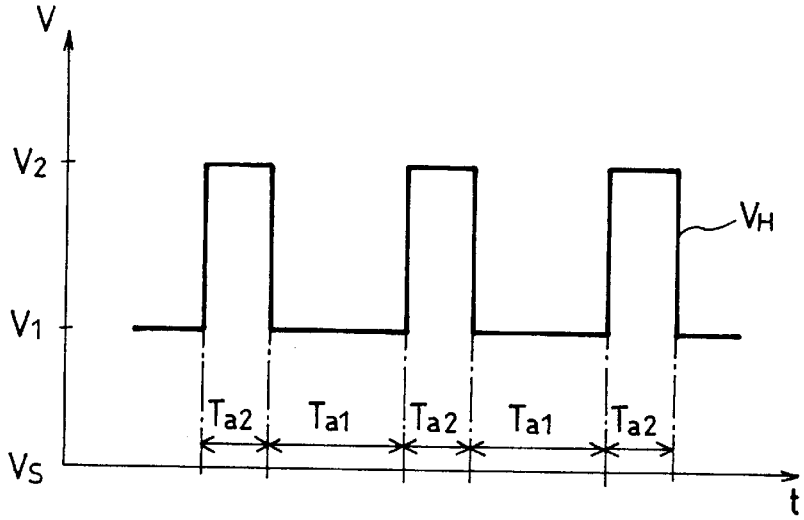
FIG. 2 is a waveform illustration showing the waveform of an output voltage of the voltage generating circuit shown in FIG. 1.

FIG. 2 shows an example of the waveform of an output voltage $V_0$ from the output terminal 14 when the switch 11 performs switching between the terminals 11*a* and 11*b* alternately. In a period $T_{a1}$ in which the switch 11 is connected to the terminal 11*a*, the voltage $V_1$ is output through the diode 13 to the output terminal 14, and simultaneously the capacitor 12 is charged with the voltage $V_1$. Next, in a period $T_{a2}$ in which the switch 11 is connected to the terminal 11*b*, the voltage $V_0$ is increased to the voltage $V_2$ as the sum voltage of the input voltage $V_2-V_1$ and the charged voltage $V_1$ to the capacitor 12.

When the switch 11 is connected to terminal 11*a* again, the voltage $V_1$ is output as the output voltage $V_0$ to the output terminal 14. At this time, immediately after the switch 11 is connected to the terminal 11*a*, a reverse current flows into the voltage generating circuit 53 from the liquid crystal panel 50 and is stored on the capacitor 12 through the output terminal 14. Consequently, the amount of current that flows from the input terminal 10*a* and is consumed by charging of the capacitor 12 is reduced, thereby lowering the power consumption.

Figure 17:
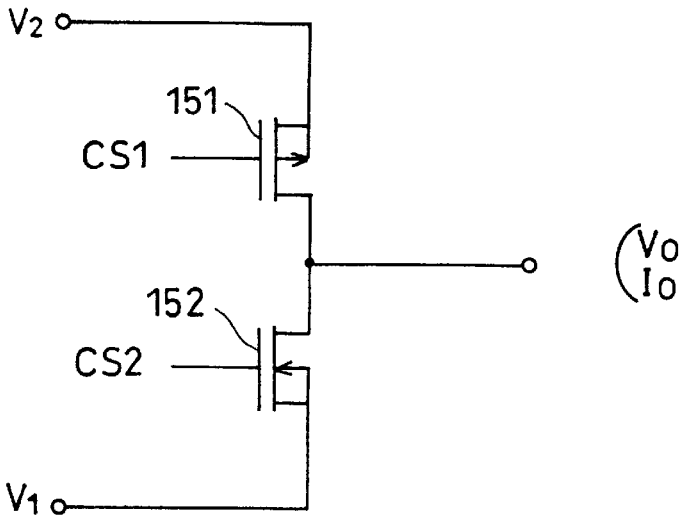
FIG. 17 is a circuit diagram showing the structure of a conventional voltage generating circuit.
Figure 18:
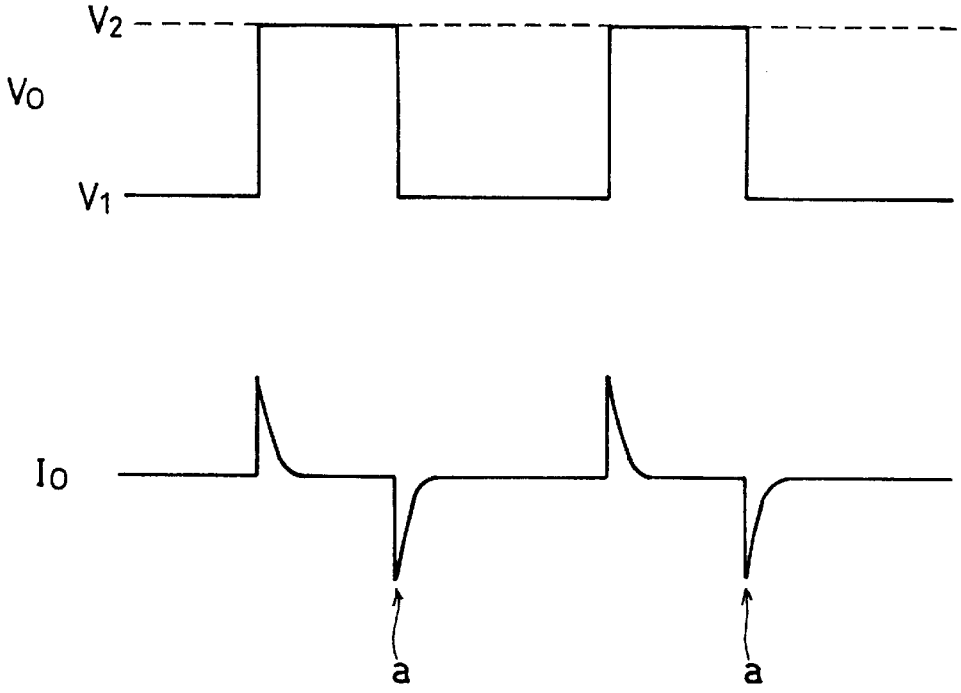
FIG. 18 is a waveform illustration showing the waveforms of an output voltage and an output current of a conventional voltage generating circuit.

The voltage generating circuit 53 repeats the above-mentioned operation by switching the switch 11, and outputs a rectangular wave $V_H$ like the one shown in FIG. 2 from the output terminal 14. As described above, in the voltage generating circuit 53, the values of the input voltages necessary for generating output voltages $V_1$ and $V_2$ are $V_1$ and $V_2-V_1$ if a sufficient amount of charge is stored on the capacitor 12. Here, the voltages satisfy the relationship $V_2-V_1<V_2$. Namely, in a conventional voltage switching circuit shown in FIG. 17, the input voltages need to have values $V_1$ and $V_2$ in order to generate output voltages $V_1$ and $V_2$. Whereas, according to the voltage generating circuit of this embodiment, one of the input voltages can be a voltage $V_2-V_1$ that is lower than $V_2$. Accordingly, the component parts of the voltage generating circuit 53 and their peripheral members are not required to have a withstanding property as high as that required by a conventional circuit, thereby achieving reduction in cost and power consumption.

[Embodiment 2]

Figure 7:
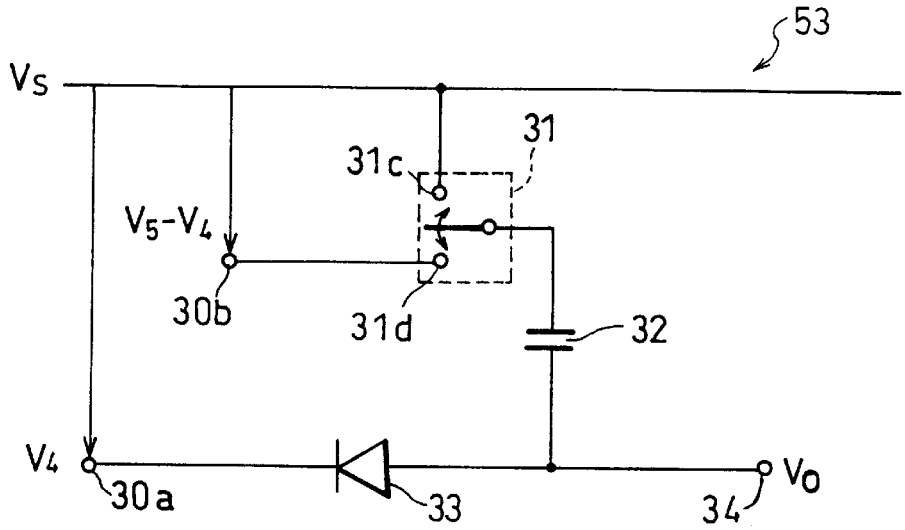
FIG. 7 is a circuit diagram showing the structure of a voltage generating circuit according to another embodiment of the present invention.
Figure 8:
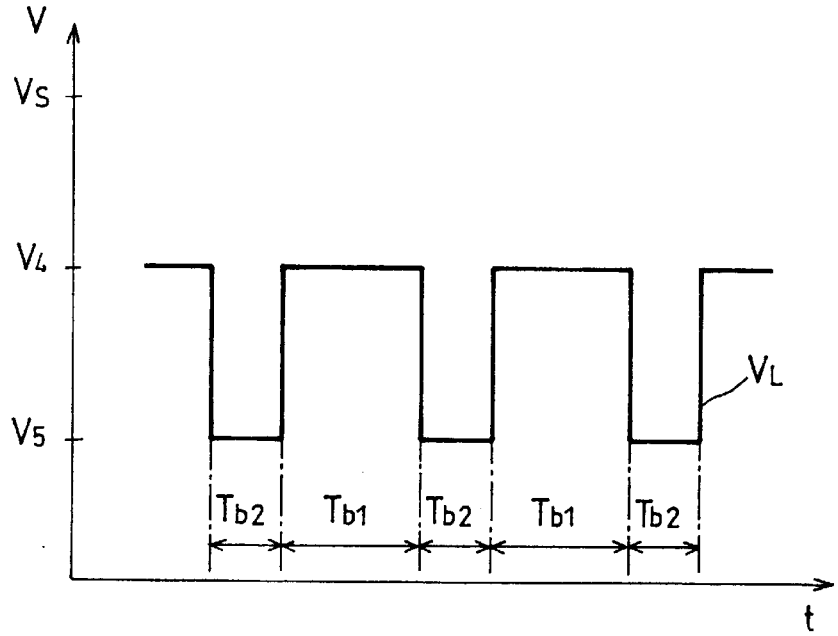
FIG. 8 is a waveform illustration showing the waveform of an output voltage of the voltage generating circuit shown in FIG. 7.

The following description will explain another embodiment of the present invention with reference to FIGS. 7 and 8. The structures having the same functions as those in Embodiment 1 will be designated by the same codes and their description will be omitted.

This embodiment explains an example of the structure of the voltage generating circuit 53, in which an input voltage having a negative polarity with respect to the reference voltage $V_S$ is used. As illustrated in FIG. 7, the voltage generating circuit 53 has input terminals 30*a*, 30*b* for inputting voltages of the negative polarity with respect to the reference voltage $V_S$. The voltages input to the input terminals 30*a*, 30*b*, respectively, are constant voltages of the negative polarity with respect to the reference voltage $V_S$, and their electric potentials with respect to the reference voltage $V_S$ are $V_4$ and $V_5-V_4$, respectively. Here, the voltages satisfy the relationship $V_S>V_4>V_5$.

A diode 33 is disposed between the input terminal 30*a* and the output terminal 34. A switch 31 for switching the reference voltage $V_S$ and the input voltage $V_5-V_4$ from the input terminal 30*b* is provided. A terminal of the switch 31, connected to the reference voltage $V_S$, is represented by 31*c*, while a terminal connected to the input voltage $V_5-V_4$ is indicated by 31*d*. A capacitor 32 is positioned between the switch 31 and output terminal 34.

FIG. 8 shows an example of the waveform of an output voltage $V_0$ from the output terminal 34 when the switch 31 performs switching between the terminals 31*c* and 31*d* alternately. In a period $T_{b1}$ in which the switch 31 is connected to the terminal 31*c*, the voltage $V_4$ is output through the diode 33 to the output terminal 34, and simultaneously the capacitor 32 is charged with the voltage $V_4$. Next, in a period $T_{b2}$ in which the switch 31 is connected to the terminal 31*d*, the output voltage $V_0$ becomes the voltage $V_S$ as the sum voltage of the input voltage $V_5-V_4$ and the charged voltage $V_4$ to the capacitor 32.

When the switch 31 is connected to the terminal 31*c* again, the voltage $V_4$ is output as the output voltage $V_0$ to the output terminal 34. At this time, immediately after the switch 31 is connected to the terminal 31*c*, a reverse current flows into the voltage generating circuit 53 from the liquid crystal panel 50 and is stored on the capacitor 32 through the output terminal 34. Consequently, the amount of current that flows from the input terminal 30*a* and is consumed by charging of the capacitor 32 is reduced, thereby lowering the power consumption.

The voltage generating circuit 53 repeats the above-mentioned operation by switching the switch 31, and outputs the rectangular wave $V_L$ like the one shown in FIG. 8 from the output terminal 34. As described above, in the voltage generating circuit 53, the values of the input voltages necessary for generating output voltages $V_4$ and $V_5$ are $V_4$ and $V_5-V_4$, if a sufficient amount of charge is stored on the capacitor 32. Here, $|V_5-V_4|<|V_5|$. Namely, in a conventional voltage switching circuit like the one shown in FIG. 17, the input voltages need to have values $V_4$ and $V_5$ in order to generate output voltages $V_4$ and $V_5$ ($|V_4|<|V_5|$). Thus, the absolute value of the input voltage necessary for the voltage generating circuit 53 of this embodiment is smaller than that of the conventional circuit. Accordingly, the component parts of the voltage generating circuit 53 of this embodiment and their peripheral members are not required to have a withstanding property as high as that required by the conventional circuit, thereby achieving reduction in cost and power consumption.

[Embodiment 3]

Figure 9:
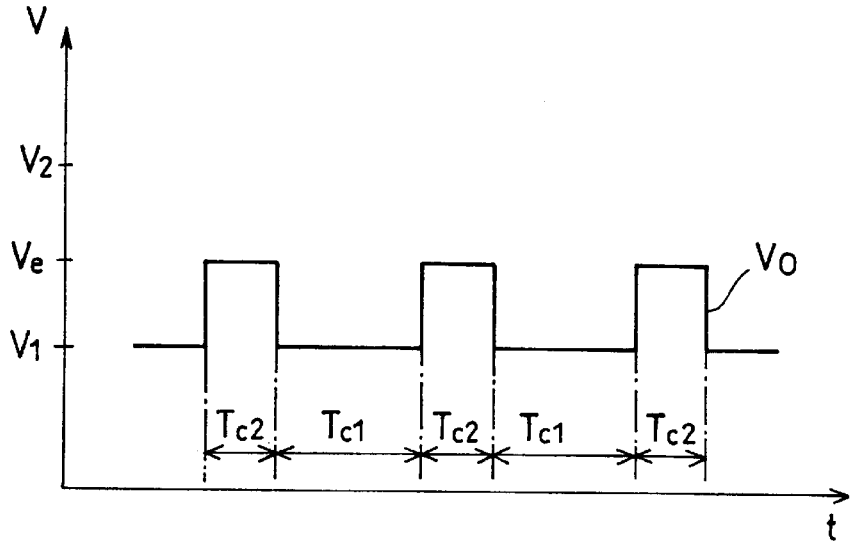
FIG. 9 is a waveform illustration showing the waveform of an output voltage of a voltage generating circuit according to still another embodiment of the present invention.
Figure 10:
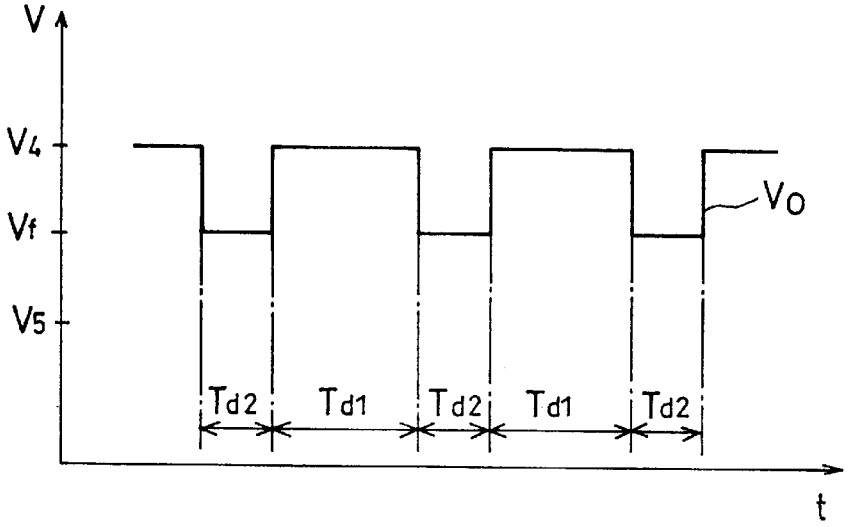
FIG. 10 is a waveform illustration showing the waveform of an output voltage of a voltage generating circuit according to yet another embodiment of the present invention.

The following description will explain still another embodiment of the present invention with reference to FIGS. 9 and 10. The structures having the same functions as those in Embodiments 1 and 2 will be designated by the same codes and their description will be omitted.

The voltage generating circuit 53 according to this embodiment has the structure shown in FIG. 1 of Embodiment 1, and is characterized by the capacitor 12 whose capacity is made smaller than a load capacity. The "load capacity" is a capacity given by the sum of the liquid crystal capacity and the element capacity of the liquid crystal panel 50. In this arrangement, the amount of charge for charging the capacitor 12 is not sufficient with respect to the voltage $V_1$. Therefore, when the switch 11 is switched between the terminals 11*a* and 11*b*, voltages $V_1$ and $V_e$ ($V_1 \leqq V_e \leqq V_2$) are alternately output as the output voltage $V_0$ from the output terminal 14 as shown in FIG. 9. Namely, by appropriately setting the capacity of the capacitor 12 within a range smaller than the load capacity, it is possible to achieve a voltage generating circuit 53 capable of outputting the voltage $V_1$ and any voltage $V_e$ within the range ($V_1 \leqq V_e \leqq V_2$) alternately, using the input voltages $V_1$ and $V_2-V_1$.

Similarly, in the structure shown in FIG. 7 of Embodiment 2, by arranging the capacity of the capacitor 32 to be smaller than the load capacity, the voltage $V_4$ and any voltage $V_f$ within a range $V_5 \leqq V_f \leqq V_4$ are alternately output as the output voltage $V_0$ from the output terminal 34 as shown in FIG. 10. Namely, by appropriately setting the capacity of the capacitor 32 within the range smaller than the load capacity, it is possible to achieve a voltage generating circuit 53 capable of outputting the voltage $V_4$ and any voltage $V_f$ within the range ($V_5 \leqq V_f \leqq V_4$) alternately, using the input voltages $V_4$ and $V_5-V_4$.

Moreover, in Embodiment 1, even when the period $T_{a1}$ in which the switch 11 is connected to the terminal 11*a* is not so long as to permit storing of a sufficient amount of charge on the capacitor 12, effects similar to those mentioned above can be produced by outputting the sum voltage of the voltage $V_2-V_1$ and a differential voltage according to the amount of charge charged onto the capacitor 12. Furthermore, in Embodiment 2, even when the period $T_{b1}$ in which the switch 31 is connected to the terminal 31*c* is not so long as to permit storing of a sufficient amount of charge on the capacitor 32, effects similar to those mentioned above can be obtained.

[Embodiment 4]

The following description will explain yet another embodiment of the present invention with reference to FIGS. 11 to 14. The structures having the same functions as those in the above-mentioned embodiments will be designated by the same codes and their description will be omitted.

Figure 11:
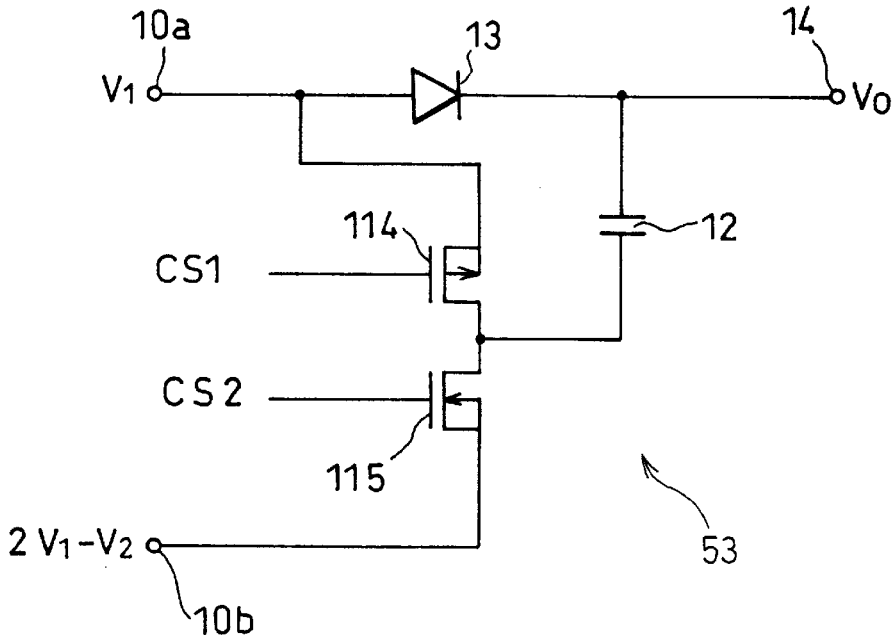
FIG. 11 is a circuit diagram illustrating the structure of a voltage generating circuit according to other embodiment of the present invention.
Figure 12:
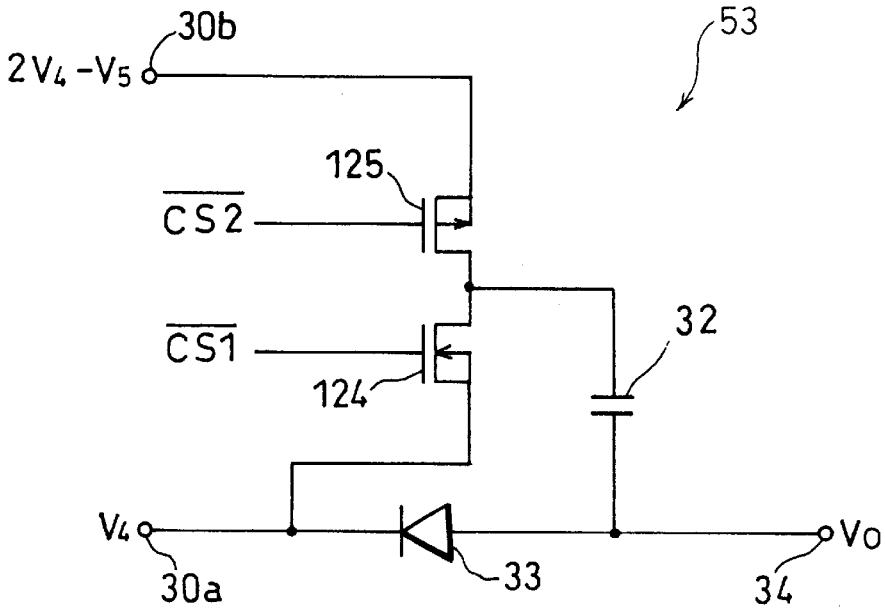
FIG. 12 is a circuit diagram illustrating the structure of a voltage generating circuit according to other embodiment of the present invention.

FIGS. 11 and 12 are circuit diagrams showing examples of the structure of the voltage generating circuit 53 explained in Embodiments 1 and 2, wherein MOS transistors are used as the switches 11 and 31, respectively.

In the structure shown in FIG. 11, a p-channel MOS transistor 114 is provided between the input terminal 10*a* and the capacitor 12, and an n-channel MOS transistor 115 is positioned between the input terminal 10*b* and the capacitor 12.

The input voltages to the input terminals 10*a*, 10*b* are $V_1$ and $2V_1-V_2$, respectively. The switching control signal CS1 is input to the p-channel MOS transistor 114, while the switching control signal CS2 is input to the n-channel MOS transistor 115.

Figure 13:
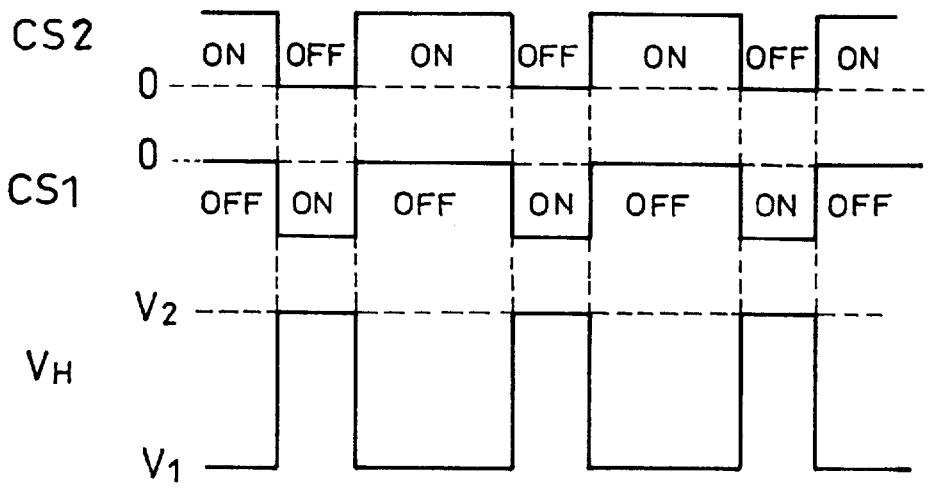
FIG. 13 is a waveform illustration showing the waveforms of switching control signals for controlling the switching operation in the voltage generating circuit shown in FIG. 11, and the waveform of an output voltage of the voltage generating circuit.
Figure 14:
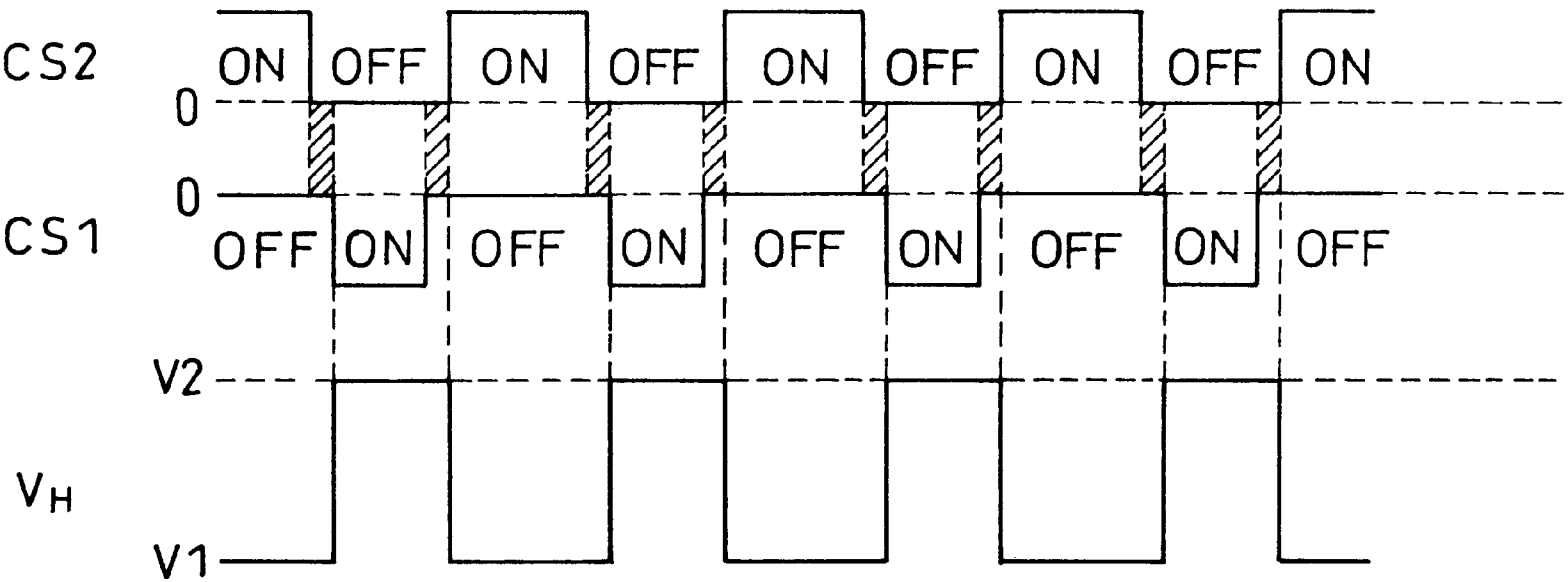
FIG. 14 is a waveform illustration showing the waveforms of switching control signals for controlling the switching operation according to other embodiment of the present invention, and the waveform of an output voltage of the voltage generating circuit.

As the switching control signals CS1 and CS2 shown in FIG. 13, signals, which are controlled and synchronized so that either of the signals is always in an ON state, are used. When the CS1 is in the ON state and the CS2 is in an OFF state, the voltage $V_1$ is output to the output terminal 14 through the diode 13 from the input terminal 10*a*. At this time, the electric potential on the output terminal 14 side of the capacitor 12 is $V_1$, while the electric potential on the n-channel MOS transistor 115 side thereof is $2V_1-V_2$. Therefore, the capacitor 12 is charged with a differential voltage $V_2-V_1$ of the electric potential on the output terminal 14 side and the electric potential on the n-channel MOS transistor 115 side. Next, when the CS2 and CS1 are switched to OFF and ON, respectively, a voltage $V_2$ that is the sum voltage of the input voltage $V_1$ from the input terminal 10*a* and the charged voltage $V_2-V_2$ to the capacitor 12 is output to the output terminal 14.

By repeating the above-mentioned operation, the scanning electrode driver input signal $V_H$ output from the output terminal 14 produces a rectangular wave in which the voltages $V_1$ and $V_2$ appear alternately.

Similarly, in the structure shown in FIG. 12, an n-channel MOS transistor 124 is provided between the input terminal 30*a* and the capacitor 32, and a p-channel MOS transistor 125 is positioned between the input terminal 30*b* and the capacitor 32. With this structure, a rectangular wave in which the voltages $V_4$ and $V_5$ appear alternately is output from the output terminal 34. Here, the inverted signal of the switching control signal CS1 (indicated by $\overline{CS1}$ in FIG. 12) is input to the n-channel MOS transistor 124, while the inverted signal of the switching control signal CS2 (indicated by $\overline{CS2}$ in FIG. 12) is input to the p-channel MOS transistor 125.

The MOS transistor permits high-speed switching with low power consumption. Therefore, the abovementioned structures can further reduce the power consumption of the voltage generating circuit 53, and produce a rectangular wave having sharp leading and trailing edges.

As the switching control signals CS1 and CS2, it is possible to use signals whose inverting timings are different from each other. For example, the switching control signals CS1 and CS2 can be input in the inverting timings shown in FIG. 14. In this case, after a period in which both of the CS1 and CS2 are in the OFF state (the period shown by hatching in FIG. 14), the CS1 or CS2 is turned ON. Accordingly, the CS1 and CS2 can never be in the ON state at the same time. It is thus possible to prevent a through current, and further reduce the power consumption compared to the structure using control signals that are controlled and synchronized so that either of the signals is always in the ON state as shown in FIG. 13.

[Embodiment 5]

Figure 15:
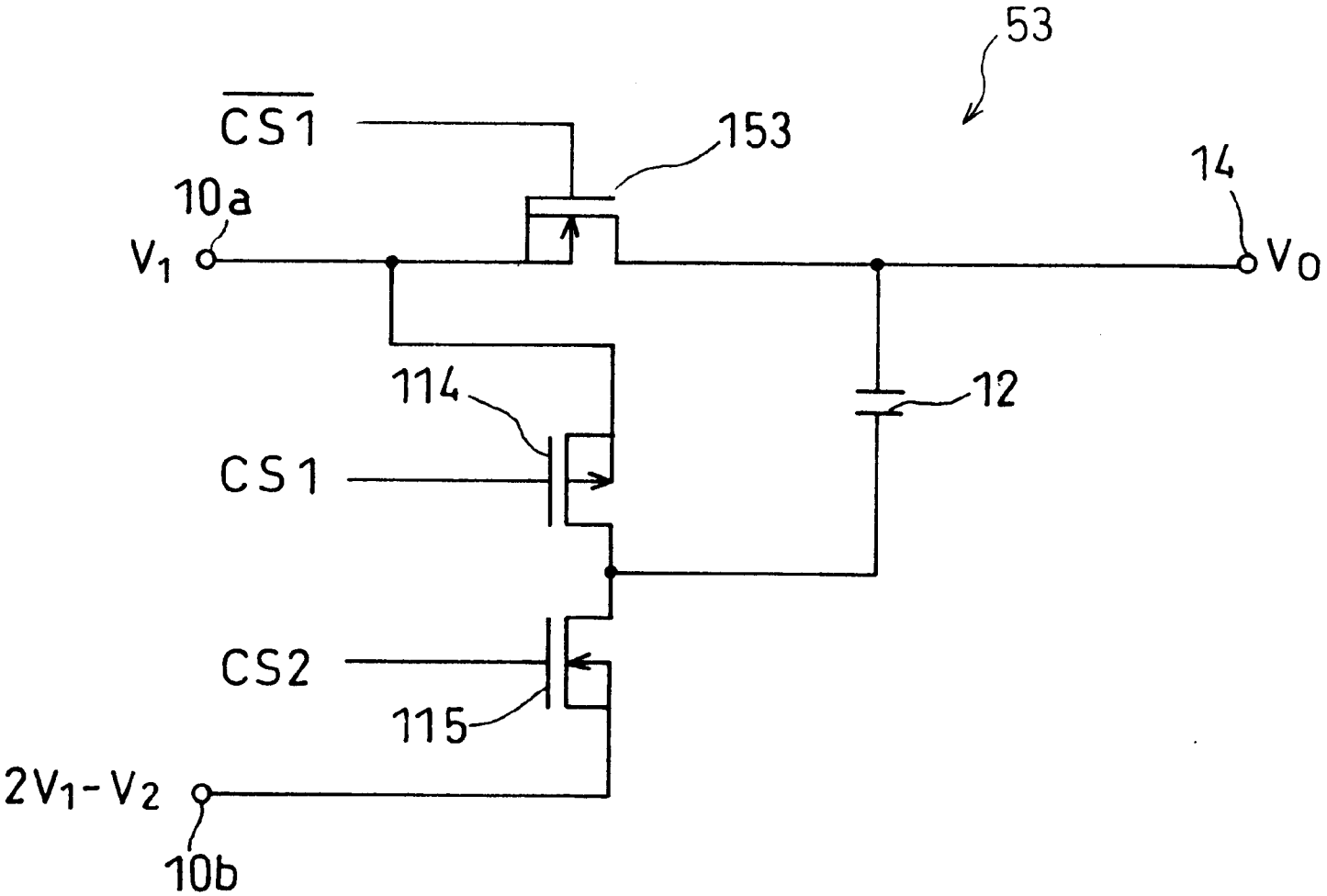
FIG. 15 is a circuit diagram illustrating the structure of a voltage generating circuit according to other embodiment of the present invention.
Figure 16:
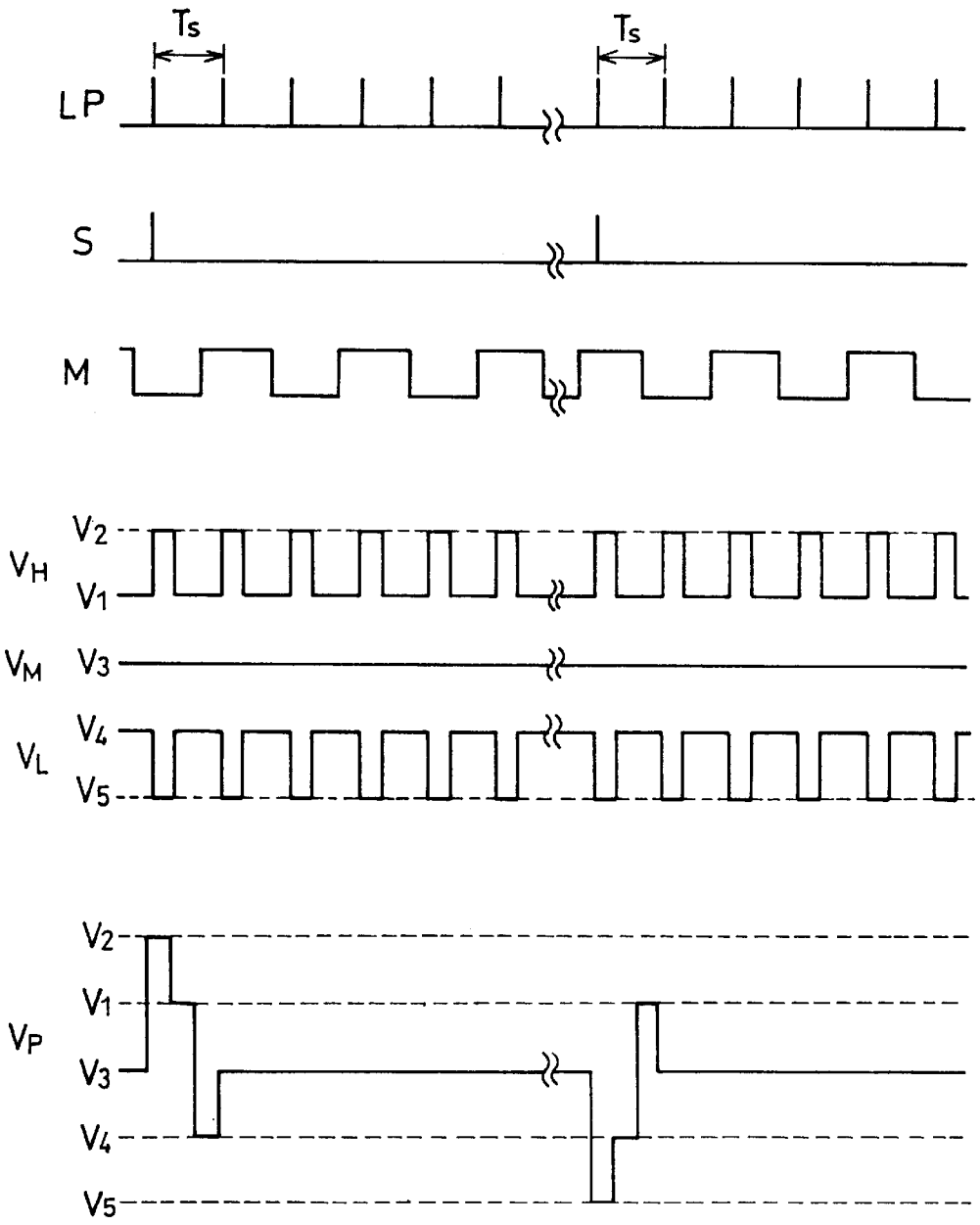
FIG. 16 is a waveform illustration showing the waveforms of various signals used in the driving method with the selection period being divided into the first through third periods, and of scanning signals generated based on the various signals.

The following description will explain other embodiment of the present invention with reference to FIG. 15. The structures having the same functions as those in the above-mentioned embodiments will be designated by the same codes and their description will be omitted.

As illustrated in FIG. 15, a voltage generating circuit of this embodiment has the structure of the voltage generating circuit 53 shown in FIG. 11 of Embodiment 4, but uses an n-channel MOS transistor 153 instead of the diode 13.

In this structure, an n-channel MOS transistor 153 is provided between the input terminal 10*a* and the output terminal 14, and the inverted signal of the switching control signal CS1 is input to the n-channel MOS transistor 153. In this case, since the timings in which the n-channel MOS transistor 153 is in the ON state and the n-channel MOS transistor 115 is in the OFF state are synchronized, the n-channel MOS transistor 153 turns into the ON state when the voltage $V_1$ is output, and into the OFF state when the voltage $V_2$ is output. Accordingly, the voltage generating circuit of this embodiment can perform the same operation as that of the structure using the diode 13. Moreover, since the MOS transistor is used, the loss of power in rectification can be reduced.

Similarly, in above-mentioned Embodiments 1 through 4, it is possible to use the MOS transistor mentioned above, in place of the diode as the rectifying element.

As explained in Embodiments 1 through 5, a voltage generating circuit of the present invention includes an output terminal connected to a display device, two input terminals to which voltages $V_a$ and $V_b$ are input, respectively, a switch positioned between the input terminals and output terminal, for switching the state between the first and second states, a capacitor provided between the switch and the output terminal, and a rectifying element connected to the capacitor in parallel, and is constructed so that the voltage $V_a$ is output from the output terminal and the capacitor is charged when the switch is in the first state, and a voltage $V_d$ as the sum voltage of a voltage $V_c$ charged on the capacitor and one of the voltages $V_a$ and $V_b$ input from the input terminals is output from the output terminal when the switch is in the second state, wherein $V_a$ and $V_d$ have the same polarity with respect to a reference voltage, $|V_a|<|V_d|$ and $|V_b|<|V_d|$.

With this structure, since the input voltage is made lower than the output voltage, it is possible to lower the withstand voltage of the peripheral members for switching the voltage. Moreover, this structure can reduce the power consumption by charging the reverse current flowing from the output terminal on the capacitor, and effectively using the charged voltage.

As explained in Embodiments 1 and 2, the abovementioned voltage generating circuit can be constructed so that $V_d=V_b+V_c$, and $V_c=V_a$.

With this structure, during a period in which the switch is in the first state, the voltage $V_a$ as one of the input voltages is output from the output terminal, and the voltage $V_c$ across the terminals of the capacitor is made equal to the voltage $V_a$ by the amount of charge stored on the capacitor. Moreover, the voltage $V_d$ to be output when the switch is turned into the second state becomes the sum of the voltage $V_b$ as the other of the input voltages and the voltage $V_c$ charged on the capacitor, i.e., $V_a$. Namely, it is possible to produce output voltages of two levels, $V_a$ and $V_a+V_b$, from the input voltages $V_a$ and $V_b$.

As explained in Embodiments 4 and 5, the above-mentioned voltage generating circuit can be constructed so that $V_d=V_a+V_c$, and $V_c=V_a-V_b$.

With this structure, during a period in which the switch is in the first state, the voltage $V_a$ as one of the input voltages is output from the output terminal, and the voltage $V_c$ between the terminals of the capacitor is made equal to the voltage $V_a-V_b$ by the amount of charge stored on the capacitor. Moreover, the voltage $V_d$ to be output when the switch is turned into the second state becomes the sum of the voltage $V_a$ and the voltage $V_c$ charged on the capacitor, i.e., $V_a-V_b$.

Namely, it is possible to produce output voltages of two levels, $V_a$ and $2V_a-V_b$, from the input voltages $V_a$ and $V_b$. In other words, for example, if the input voltages $V_a$ and $V_b$ are $V_1$ and $2V_1-V_2$, respectively, it is possible to generate $V_1$ and $V_2$ as the output voltages.

As explained in Embodiment 3, the above-mentioned voltage generating circuit can be constructed so that the capacity of the capacitor is smaller than the load capacity.

With this structure, it is possible to change the value of one output voltage which has a greater electric potential difference with respect to the reference voltage than the other output voltage, without changing the values of the input voltages.

Besides, as explained in Embodiments 4 and 5, the above-mentioned voltage generating circuit can be constructed using a MOS transistor as the switch.

With this structure, it is possible to achieve high-speed switching, and reduce the power consumed by switching.

Furthermore, as explained in Embodiment 5, the above-mentioned voltage generating circuit can be constructed using a MOS transistor as the rectifying element.

With this structure, it is possible to reduce the loss of power in the rectifying element.

A liquid crystal display device according to the present invention includes the above-mentioned voltage generating circuit, and uses non-linear elements as the switching elements in the pixels of the liquid crystal panel.

Thus, even the liquid crystal display device using the non-linear elements as the switching elements in the pixels of the display panel can have the benefit of the use of the above-mentioned voltage generating circuit. It is thus possible to provide a low-power-consuming liquid crystal display device at low cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A voltage generating circuit for supplying a voltage to a display device having a capacitive element, comprising:

an output terminal connected to said display device;

two input terminals to which voltages $V_a$ and $V_b$ are input, respectively;

a switch, provided between said output terminal and said input terminals, for switching a state between first and second states;

a capacitor provided between said switch and said output terminal; and a rectifying element connected to said capacitor in parallel, wherein, when said switch is in the first state, the voltage $V_a$ is output from said output terminal, and said capacitor is charged, when said switch is in the second state, a sum voltage $V_d$ of a voltage $V_c$ charged on said capacitor and one of the voltages $V_a$ and $V_b$ input from said input terminals is output from said output terminal, $V_a$ and $V_d$ have same polarity with respect to a reference voltage, $|V_a|<|V_d|$, and $|V_b|<|V_d|$

2. The voltage generating circuit as set forth in claim 1, wherein $V_d=V_b+V_c$, and $V_c=V_a$.

3. The voltage generating circuit as set forth in claim 2, wherein $V_a$ and $V_b$ have the positive polarity with respect to the reference voltage, $V_a-V_1$, $V_b=V_2-V_1$, and $V_1<V_2$.

4. The voltage generating circuit as set forth in claim 2, wherein $V_a$ and $V_b$ have a negative polarity with respect to the reference voltage, $V_a=V_4$, $V_b=V_5-V_4$, and $V_5<V_4$.

5. The voltage generating circuit as set forth in claim 1, wherein $V_d=V_a+V_c$, and $V_c=V_a-V_b$.

6. The voltage generating circuit as set forth in claim 5, wherein $V_a$ and $V_b$ have the positive polarity with respect to the reference voltage, $V_a=V_1$, $V_b=2V_1-V_2$, and $V_1<V_2$.

7. The voltage generating circuit as set forth in claim 5, wherein $V_a$ and $V_b$ have a negative polarity with respect to the reference voltage, $V_a=V_4$, $V_b=2V_4-V_5$, and $V_5<V_4$.

8. The voltage generating circuit as set forth in claim 1, wherein a capacity of said capacitor is lower than a load capacity.

9. The voltage generating circuit as set forth in claim 1, wherein said switch includes a switching element.

10. The voltage generating circuit as set forth in claim 9, wherein said switch includes an n-channel MOS transistor positioned between said output terminal and one of said input terminals, and a p-channel MOS transistor provided between said output terminal and the other of said input terminals.

11. The voltage generating circuit as set forth in claim 10, wherein both of switching control signals to be input to said n-channel MOS transistor and p-channel MOS transistor, respectively, have an OFF state in a predetermined period.

12. The voltage generating circuit as set forth in claim 1, wherein said rectifying element is a diode.

13. The voltage generating circuit as set forth in claim 1, wherein said rectifying element is a MOS transistor.

14. A liquid crystal display device comprising:

the voltage generating circuit defined in claim 1; and a liquid crystal panel as said display device.

15. The liquid crystal display device as set forth in claim 14, wherein said liquid crystal panel includes a non-linear switching element as said capacitive element.

16. The liquid crystal display device as set forth in claim 15, wherein said non-linear switching element is a two-terminal non-linear element.

17. The liquid crystal display device as set forth in claim 15, wherein said non-linear switching element is a three-terminal non-linear element.

* * * * *